United States Patent [19]

Volpert, Jr.

[11] Patent Number: 4,813,681

[45] Date of Patent: Mar. 21, 1989

[54] METHOD OF PLAYING AN ALIGNMENT GAME

[76] Inventor: Thomas R. Volpert, Jr., 5324 N. Linder, Chicago, Ill. 60630

[21] Appl. No.: 34,091

[22] Filed: Apr. 2, 1987

[51] Int. Cl.[4] ..... A63F 3/00

[52] U.S. Cl. ..... 273/271; 273/287; 273/288

[58] Field of Search ..... 273/264, 271, 288

[56] References Cited

U.S. PATENT DOCUMENTS

| | | | |
|---|---|---|---|
| 3,953,032 | 4/1976 | Moore et al. | 273/271 |
| 4,254,957 | 3/1981 | Kramer | 273/271 |
| 4,362,302 | 12/1982 | Gardner | 273/236 |
| 4,413,828 | 11/1983 | Gardner | 273/236 |

FOREIGN PATENT DOCUMENTS

| | | | |
|---|---|---|---|
| 21253 | 12/1902 | United Kingdom | 273/271 |

*Primary Examiner*—Anton O. Oechsle
*Attorney, Agent, or Firm*—Wood, Dalton, Phillips, Mason & Rowe

[57] ABSTRACT

A game including a plurality of playing markers adapted to be arranged in rows and columns. The playing markers include four playing markers having a first indicia thereon, four playing markers having a second indicia thereon, and a single playing marker having both a first and a second indicia thereon. The playing markers are adapted for random distribution in equal numbers to a pair of players with the remaining one of the playing markers defining a starting point, and one of the players selects one of the first and second indicia with the other of the players having the other of the first and second indicia. The one of the players thereafter places one of the playing markers in non-diagonal adjacent relation to the playing marker defining the starting point after which the other of the players places one of the playing markers in non-diagonal adjacent relation to a previously placed playing marker with the playing markers being placed in turn by the players in like fashion to form the rows and columns. With this arrangement, the rows and columns are each limited to a total of three playing markers arranged in a generally rectangular array, and the game winner is the one of the players to be the first with the corresponding one of the selected first and second indicia on the playing markers disposed in a row, a column, or diagonally.

8 Claims, 2 Drawing Sheets

METHOD OF PLAYING AN ALIGNMENT GAME

FIELD OF THE INVENTION

The present invention is generally related to games and, more particularly, to a game which can be played in various forms.

BACKGROUND OF THE INVENTION

Over the years, there have been many different types of games. These have ranged the gamut from those involving great mental prowess to games involving merely chance. Nevertheless, there is still a strong interest in game concepts that create real excitement.

More specifically, with many games, the players are placed in the position of passive observers. This is actually most true of the most expensive games that employ electronic components and the like which may or may not involve any skill on the part of the player. Still further, the game development is almost always viewed as unrealistic at best.

Because of this fact, such expensive games are often difficult to market and discarded after minimal play even when purchased by the consumer. Moreover, even when use continues, such games have consistently lacked any relationship to the excitement as well as the strategy and planning that should be the characteristic of any game. While it is generally recognized that decision making in game play is of paramount importance, there has yet to be a game that places players in a realistic decision making capacity One game of continual interest over the years is Tic-Tac-Toe. This game is, of course, universally played everywhere and at any time but, after much play, experienced players have come to view even this game as lacking in any requirement of mental ingenuity much less the mental prowess of which successful games are characterized. As a result, while the game of Tic-Tac-Toe is interesting, players oftentimes have become bored with continual play thereof.

Accordingly, it has remained to provide having a game that successfully overcomes the above-stated problems and completely accomplishes the stated objects.

SUMMARY OF THE INVENTION

For this reason, the present invention is directed to a game having a plurality of playing markers adapted to be arranged in rows and columns. The playing markers include four playing markers having a first indicia thereon, four playing markers having a second indicia thereon, and a single playing marker having both a first and a second indicia thereon. The playing markers are adapted for random distribution in equal numbers to a pair of players with the remaining one of the playing markers defining a starting point and one of the players selecting one of the first and second indicia with the other of the players having the other of the first and second indicia. The one of the players thereafter places one of the playing markers in nondiagonal adjacent relation to the playing marker defining the starting point after which the other of the players places one of the playing markers in non-diagonal adjacent relation to a previously placed playing marker and the playing markers are placed in turn by the players in like fashion to form the rows and columns. With this arrangement, the rows and columns are each limited to a total of three playing markers arranged in a generally rectangular array, and the game winner is the one of the players to be the first with the corresponding one of the first and second indicia on the playing markers disposed in a row, a column, or diagonally.

In the exemplary embodiment, the first indicia is an "X" and the second indicia is an "O" with the single playing marker having both an "X" and an "O" thereon. The playing markers are, in one form of the invention, playing cards which are shuffled and dealt such that each of the players has four of the playing cards. Furthermore, the game preferably includes a placement area for the playing markers having a plurality of marker-receiving spaces including the starting point thereon.

With these features, the marker-receiving spaces include a middle space defining the starting point. The marker-receiving spaces are arranged to define a plurality of rows and columns thereon with each of the rows and columns being defined by five of the marker-receiving spaces. Furthermore, the remaining one of the playing markers is preferably positioned at the starting point to initiate play.

In another embodiment, the playing markers are wearable markers for a plurality of persons all but one of whom is chosen by the players or coaches. Each of the players or coaches has four of the persons on his or her side. When so selected, the persons all blindly select one of the wearable markers with the remaining one of the persons being positioned at the starting point.

When the game takes the form of a card game, it includes a plurality of playing cards adapted to be arranged in rows and columns. The playing cards then include four playing cards having a first indicia thereon, four playing cards having a second indicia thereon, and a single playing card having both a first and a second indicia thereon. Moreover, the playing cards are shuffled and dealt such that each of a pair of players has four of the playing cards.

In this embodiment, the card game includes a supporting surface for the playing cards. The supporting surface has a plurality of card-receiving spaces including a middle space defining the starting point and the spaces are arranged to define a plurality of rows and columns thereon. Still further, the rows and columns are each defined by five of the card-receiving spaces.

As before, the remaining one of the playing cards is positioned at the starting point defined by the middle space of the card-receiving spaces. One of the players then selects one of the first and second indicia and the other of the players has the other of the first and second indicia after which one of the players plays one of the playing cards by placing it in one of the card-receiving spaces on the supporting surface in non-diagonal adjacent relation to the remaining one of the playing cards at the starting point followed by the other of the players playing one of the playing cards by placing it in another of the card-receiving spaces on the supporting surface in non-diagonal adjacent relation to a previously played playing card. In this manner, the playing cards are played in turn by the players in like fashion in a maximum of three rows and columns in a generally rectangular array, and the game winner is again the one of the players to be the first with the corresponding one of the first and second indicia on three of the playing cards in a row, a column, or diagonally.

Preferably, the supporting surface includes a playing board having a total of twenty-five card-receiving spaces disposed in five rows and five columns. The playing cards are then shuffled and dealt face down with the remaining one of the playing cards being positioned face up at the starting point. In so doing, one of the players shuffles and deals the playing cards while the other of the players selects one of the first and second indicia.

When this has been done, the other of the players selecting one of the first and second indicia plays one of the playing cards bearing the selected one of the first and second indicia to initiate play. Thereafter, the one of the players shuffling and dealing the playing cards plays any one of the playing cards by placing it in non-diagonal adjacent relation to a previously played playing card.

In the preferred embodiment, the game winner is awarded a selected point total for placing one of his or her playing cards so as to have three of the playing cards of the winner in a row, a column, or diagonally. However, the game winner is awarded double the selected point total where it is the other of the players who places one of the playing cards so as to have three of the playing cards of the winner in a row, a column, or diagonally.

In another version of the game, a lawn game includes a plurality of wearable markers for a plurality of players. The markers, as before, include four markers having a first indicia thereon, four markers having a second indicia thereon, and a single marker having both a first and a second indicia thereon. In addition, the players are chosen by each of a pair of coaches such that each of the coaches has four of the players.

When so chosen, all of the players blindly select one of the markers and the remaining non-selected one of the players is positioned at a starting point on a supporting surface for the players. The supporting surface has a plurality of player-receiving spaces including a middle space, as with the card game, defining the starting point. As with the earlier discussed embodiments, the spaces are arranged to define a plurality of rows and columns thereon and each of the rows and columns is defined by five of the player-receiving spaces.

With regard to the lawn game, one of the coaches selects one of the first and second indicia and the other of the coaches has the other of the first and second indicia. Thereafter, one of the coaches places one of the players chosen by that coach on one of the player-receiving spaces on the supporting surface in non-diagonal adjacent relation to the remaining one of the players at the starting point after which the other of the coaches places one of the players chosen by that coach on another of the player-receiving spaces on the supporting surface in non-diagonal adjacent relation to a previously placed player. In this manner, the players are placed in turn by the coaches in like fashion in a maximum of three rows and columns in a generally rectangular array.

As with the card game, the game winner is the one of the coaches to be the first with the players chosen by that coach with the corresponding one of the selected first and second indicia on the markers on three of the player-receiving spaces in a row, a column, or diagonally. Moreover, the supporting surface preferably includes a playing mat having a total of twenty-five player-receiving spaces disposed in five rows and five columns. Preferably, the coaches flip a coin to determine the one of the coaches to select from the one of the first and second indicia to be utilized in playing the lawn game, and the wearable markers are bib-type overlays normally disposed in an inwardly rolled configuration prior to selection by the players to conceal the indicia thereon.

In playing the game, the coach winning the coin flip places one of the players chosen by that coach and bearing the selected one of the first and second indicia to initiate play. Thereafter, the coach losing the coin flip places any one of the players chosen by that coach in nondiagonal adjacent relation to a previously placed one of the players.

While discussed as a card game and a lawn game, it will be understood that the game of the present invention is not so limited. For instance, it could equally well be formulated as a video or computer-type game and can take other physical forms, as well. In fact, still other objects, advantages and features of the present invention will become apparent from the following specification taken in conjunction with the accompanying drawings.

DETAILED DESCRIPTION OF THE PREFERRED EMBODIMENTS

Figure 1:
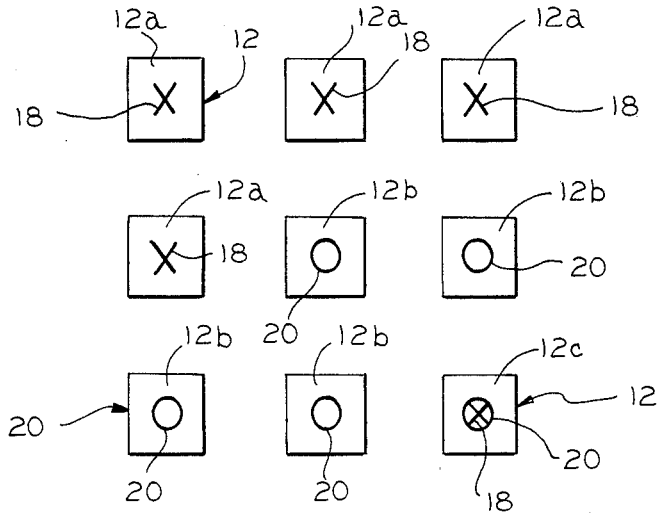
FIG. 1 is a top plan view of a plurality of playing markers in accordance with the present invention.
Figure 2:
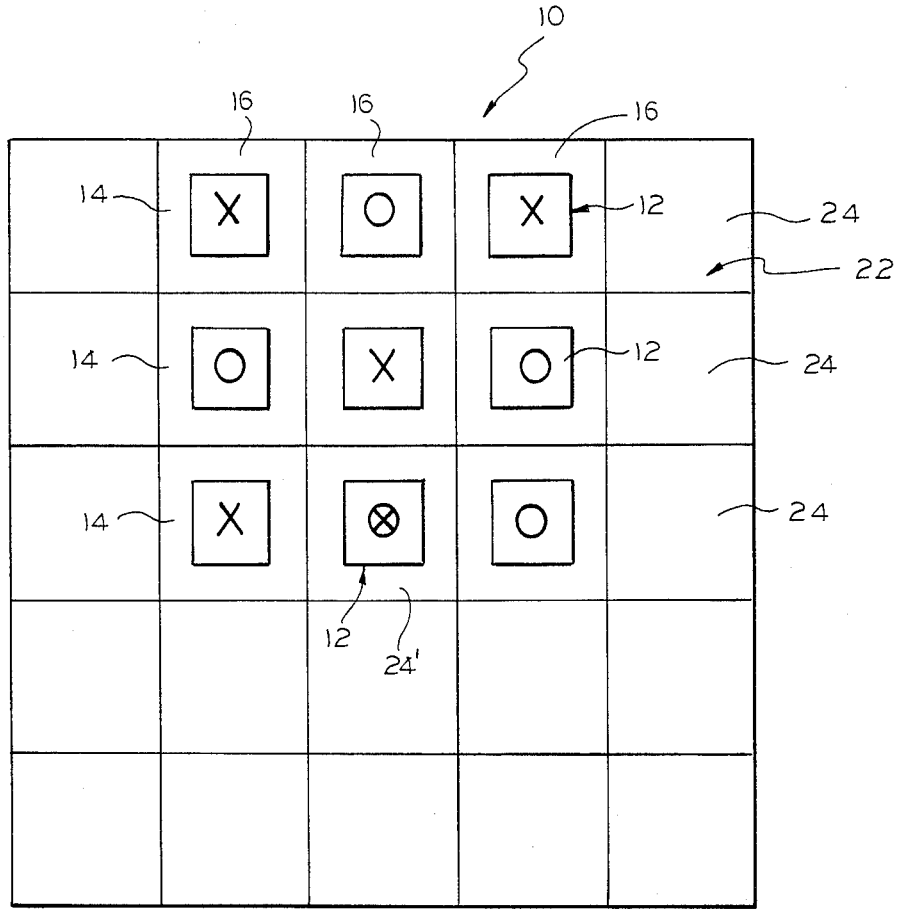
FIG. 2 is a top plan view of a supporting surface bearing the playing markers thereon.

Referring to the drawings and first to FIGS. 1 and 2, a game in accordance with the invention is illustrated. The game, generally designated 10, includes a plurality of playing markers 12 adapted to be arranged in rows 14 and columns 16. The playing markers 12 include four playing markers **12*a* having a first indicia 18 thereon, four playing markers 12*b* having a second indicia 20 thereon, and a single playing marker 12*c* having both a first and a second indicia 18 and 20 thereon. The playing markers 12 are adapted for random distribution in equal numbers to a pair of players with the remaining one of the playing markers being placed down to define a starting point, and one of the players selects one of the first and second indicia 18 and 20 with the other of the players having the other of the first and second indicia 18 and 20. The one of the players thereafter places one of the playing markers 12 in non-diagonal adjacent relation to the playing marker defining the starting point after which the other of the players places one of the playing markers 12 in non-diagonal adjacent relation to a previously placed playing marker 12. The playing markers 12 are placed in turn by the players in like fashion to form or complete the rows and columns 14 and 16. With this arrangement, the rows and columns 14 and 16 are each limited to a total of three playing markers 12 arranged in a generally rectangular array (see FIG. 2) and the game winner is the one of the players to be the first with the corresponding one of the selected first and second indicia 18 and 20 on the playing markers 12 disposed in a row 14, a column 16**, or diagonally.

Still referring to FIGS. 1 and 2, the first indicia 18 is an "X" and the second indicia 20 is an "O" with the single playing marker 12c having both an "X" and an "O" thereon. The playing markers 12 in the embodiment illustrated in FIGS. 1 and 2 are playing cards. The playing cards are shuffled and dealt such that each of the players has four and, in the preferred embodiment, the game 10 includes a placement area generally designated 22 for the playing markers 12.

As shown, the placement area 22 has a plurality of marker-receiving spaces 24 including a starting point 24' defined by a middle space and the marker-receiving spaces 24 and 24' are arranged to define a plurality of rows and columns such as 14 and 16 thereon. In the embodiment illustrated in FIGS. 1 and 2, the rows and columns such as 14 and 16 are each defined by five of the marker-receiving spaces 24 and 24' with the remaining one of the playing markers 12 being positioned at the starting point 24'.

Figure 3:
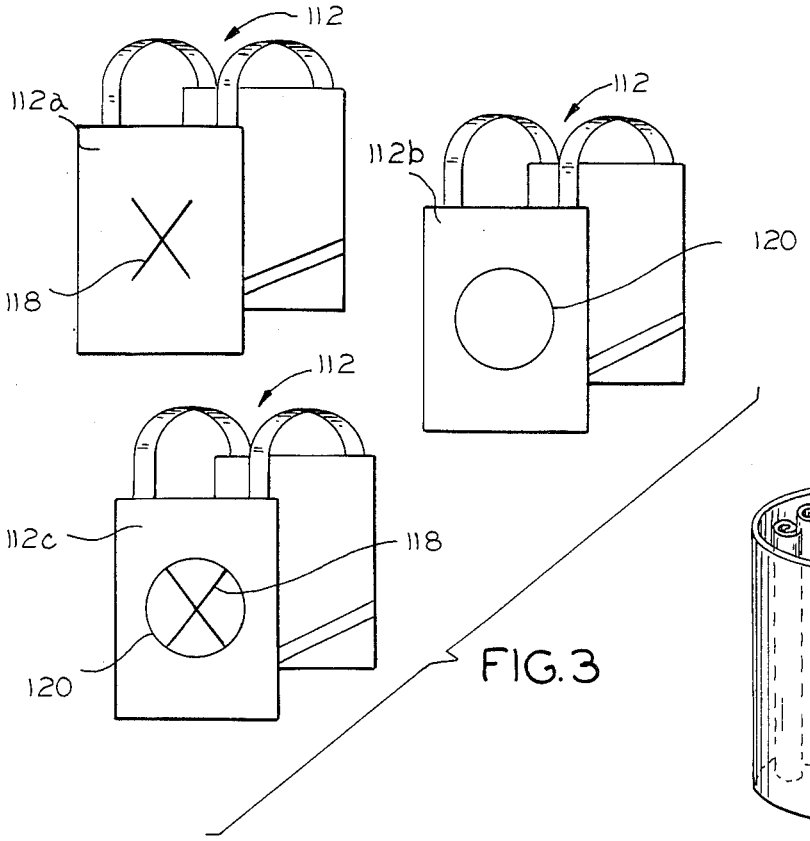
FIG. 3 is a perspective view of wearable markers in accordance with the present invention.
Figure 4:
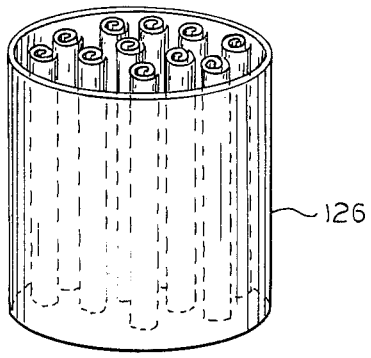
FIG. 4 is a perspective view of a storage tube for the wearable markers of FIG. 3.
Figure 5:
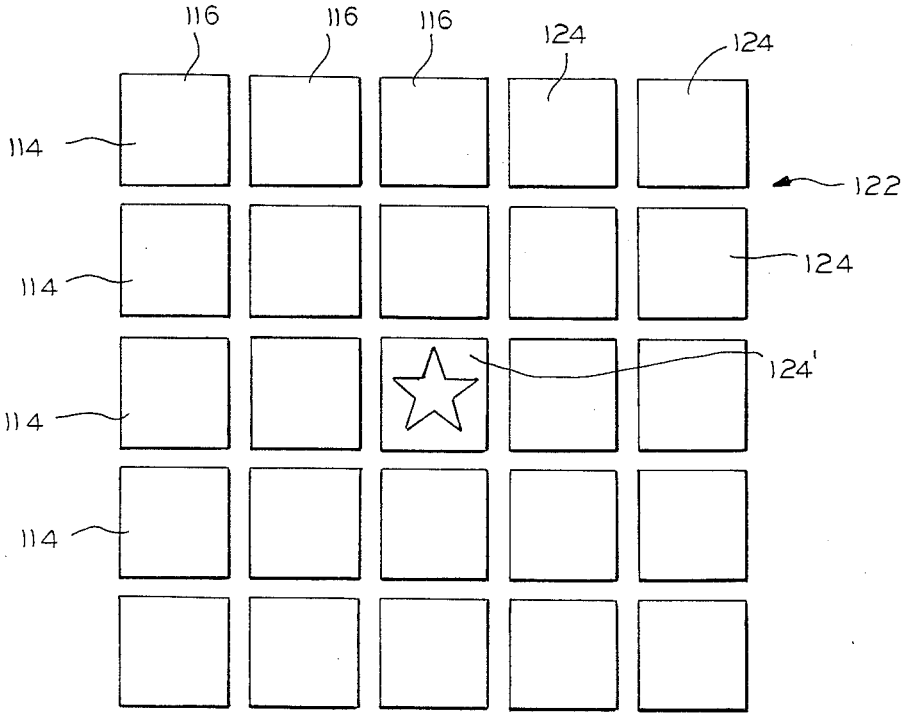
FIG. 5 is a top plan view of another supporting surface for a lawn game.

In the embodiment illustrated in FIGS. 3 through 5, the playing markers 112 are wearable markers for a plurality of persons chosen by the players or coaches. The persons are chosen such that each of the players or coaches has four of the persons on a side. When so chosen, the persons all blindly select one of the wearable markers 112 and the remaining non-selected one of the persons is positioned at the starting point 124'.

Referring once again to FIGS. 1 and 2, the game 10 can take the form of a card game having a plurality of playing cards 12 adapted to be arranged in rows and columns such as 14 and 16. The playing cards 12 include the four playing cards 12a having the first indicia or "X" 18 thereon, the four playing cards 12b having the second indicia or "O" 20 thereon, and the single playing card 12c having both the first and second indicia or an "X" and an "O" 18 and 20 thereon. In the card game format of the game 10, the playing cards 12 are shuffled and dealt such that each of a pair of players has four of the playing cards.

As shown in FIG. 2, the card game 10 includes a supporting surface 22 having a plurality of card-receiving spaces 24 for the playing cards 12, as previously discussed. The middle space 24' defines the starting point and the spaces 24 and 24' are arranged to define a plurality of rows and columns such as 14 and 16 thereon. Also, as previously discussed, the rows and columns such as 14 and 16 are each o defined by five of the card-receiving spaces 24 and 24' with the remaining one of the playing cards 12 being positioned at the starting point 24' defined by the middle space of the card-receiving spaces 24.

After the cards 12 have been shuffled and dealt, one of the players plays one of the playing cards 12 by placing it in one of the card-receiving spaces 24 on the supporting surface 22 in non-diagonal adjacent relation to the remaining one of the playing cards 12 at the starting point 24'. Next, the other of the players plays one of the playing cards 12 by placing it in another of the card-receiving spaces 24 in the supporting surface 22 in non-diagonal adjacent relation to a previously played playing card 14. In this manner, the players continue to play the playing cards 12 in turn in like fashion so as to form a maximum of three rows and columns in a generally rectangular array (see 14 and 16).

During the course of play, the game winner is the one of the players to be the first with the corresponding one of the first and second indicia 18 and 20 selected by that player on three of the playing cards 12 in a row such as 14, a column such as 16, or diagonally (see the "X's" in FIG. 2 from lower left to upper right).

In the preferred embodiment, the supporting surface 22 comprises a playing board having a total of twenty-five card-receiving spaces 24 and 24' disposed in five rows and five columns such as 14 and 16. The playing cards 12 are shuffled and dealt face down with the remaining one of the playing cards 12 being positioned face up at the starting point 24'. Preferably, one of the players shuffles and deals the playing cards 12 and the other of the players selects one of the first and second indicia 18 and 20.

When this has been done, the other of the players selecting one of the first and second indicia 18 and 20 plays one of the playing cards 12 bearing the selected one of the first and second indicia 18 and 20 to initiate play. Thereafter, the one of the players shuffling and dealing the playing cards 12 plays any one of the playing cards 12 by placing it in non-diagonal adjacent relation to a previously played playing card 12

As play progresses, the game winner is awarded a selected point total for placing one of his or her playing cards 12 so as to have three of the playing cards 12 bearing the winner's selected indicia 18 and 20 in a row, a column, or diagonally. Moreover, the game winner is awarded double the selected point total where the other of the players places one of his or her playing cards 12 so as to have three of the playing cards 12 bearing the winner's selected indicia 18 and 20 in a row, a column, or diagonally.

While described as a card game, it will be appreciated that the embodiment mentioned can also be utilized in other media. For instance, the game 10 is particularly well suited for use as a video or computer-type game. In addition, still other types of physical embodiments utilizing the unique game concept of the invention will occur to those with game-oriented backgrounds.

In the embodiment illustrated in FIGS. 3–5, the game takes the form of a lawn game having a plurality of wearable markers 112 for a plurality of players. The markers 112 include four markers 112a having a first indicia 118 thereon, four markers 112b having a second indicia 120 thereon, and a single marker 112c having both a first and second indicia 118 and 120 thereon. In this version, the players are chosen by each of a pair of coaches such that each of the coaches has four of,the players.

When so chosen, all of the players blindly select one of the markers 112. This is preferably done by providing the wearable markers 112 in the form of bib-type overlays normally disposed in an inwardly rolled configuration to conceal the indicia 118 and/or 120 thereon from view with the bib-type overlays being stored in a tube 126 (see FIG. 4) After selecting the wearable markers 112, the remaining non-selected one of the players is positioned at the starting point 124' on a supporting surface 122 for the players (see FIG. 5).

The supporting surface 122 has a plurality of player-receiving spaces 124 including a middle space defining the starting point 124'. The spaces 124 and 124' are arranged to define a plurality of rows and columns 114 and 116 thereon. As shown, the rows and columns 114 and 116 are each defined by five of the player-receiving spaces 124 and 124'.

In the lawn game, one of the coaches selects one of the first and second indicia 118 and 120 and the other of the coaches has the other of the first and second indicia 118 and 120. One of the coaches thereafter places one of the players chosen by that coach on one of the player-receiving spaces 124 on the supporting surface 122 in nondiagonal adjacent relation to the remaining one of the players at the starting point 124' after which the other of the coaches places one of the players chosen by that coach on another of the player-receiving spaces 124 on the supporting surface 122 in non-diagonal adjacent relation to a previously placed player. In this manner, the players are placed in turn by the coaches in like fashion in a maximum of three rows 114 and columns 116 in a generally rectangular array (such as that disclosed in connection with the card game in FIG. 2).

As before, the game winner is the one of the coaches to be the first with players with the corresponding one of the first and second indicia 118 and 120 selected by that coach on three of the player-receiving spaces 124 and 124' in a row, a column, or diagonally.

Referring to FIG. 5, the supporting surface 122 preferably includes a playing mat or mats having a total of 25 player-receiving spaces 124 and 124' disposed in five rows 114 and five columns 116. It will be appreciated that a plurality of playing mats comprising the supporting surface 122 are disclosed in FIG. 5, although the individual player-receiving spaces 124 and 124' can be disposed on a single, large playing mat, or the individual spaces 124 and 124' can be connected together in any conventional fashion, either permanently or temporarily, after shipment and removal from the shipping container. In any event, the coaches flip a coin to determine the one of the coaches to select from the one of the first and second indicia 118 and 120 to be utilized in playing the lawn game.

When this has been done, the coach winning the coin flip places one of the players chosen by that coach and bearing the selected one of the first and second indicia 118 and 120 to initiate play. Thereafter, the coach losing the coin flip places any one of the players chosen by that coach in non-diagonal adjacent relation to a previously placed one of the players.

As previously suggested, the lawn game is preferably provided with a tubular container 126. This tubular container 126 is utilized to store everything including the playing mat or mats comprising the supporting surface 122 as well as the wearable markers 112. In addition, the tubular container 126 is utilized for blindly selecting the wearable markers 112 which are reverse-rolled to conceal the first and second indicia 118 and 120.

In all versions of the game, the single playing marker **12*c* or 112*c* having both the first and second indicia 18 and 20 or 118 and 120 is always both an "X" and an "O" which is true whenever it is played so that either player or coach can take advantage of this fact. However, if both players or coaches immediately have three of the selected first and second indicia in a row, a column, and/or diagonally, only the one of the players or coaches playing the marker 12*c* or 112*c*** can be declared the game winner.

When this occurs, the game winner is awarded the selected point total for placing the winning marker or card. however, in the event that the only player or coach to immediately win is not the one who played the single marker **12*c* or 112*c***, the game winner is awarded double the selected point total. Moreover, while no diagonal play is allowed, the game winner can result from diagonal completion of selected indicia from horizontal or vertical marker placement.

As will be appreciated, the supporting surface 22 or 122 includes sixteen extra spaces 24,24' and 124,124'. More particularly, there are sixteen more spaces 24,24' and 24,124' than there are markers or playing cards 12 and 112. Thus, while the extra marker or playing card 12 or 112 is initially placed at the middle space 24' or 124', the true middle space of the developing game is entirely uncertain.

As a result of the uncertainty of the middle space, the strategy of play is quite sophisticated. It is entirely far more complex and challenging than Tic-Tac-Toe and other games of the type. As a result, it maintains interest for long periods, is economical to manufacture, and offers a challenge to even well seasoned game players.

While in the foregoing there have been set forth preferred embodiments of the invention, it is to be understood that the invention is only to be limited by the spirit and scope of the appended claims.

I claim:

1. A method of playing a game, comprising the steps of:

providing a plurality of playing markers adapted to be arranged in rows and columns including four playing markers having a first indicia thereon, four playing markers having a second indicia thereon, and a single playing marker having both a first and a second indicia thereon;

randomly distributing four of said playing markers to each of a pair of players;

placing the remaining one of said playing markers in a position defining a starting point;

one of said first and second indicia being selected by one of said players and the other of said players having the other of said first and second indicia, one of said playing markers thereafter being placed in non-diagonal adjacent relation to said playing marker defining said starting point by one of said players after which the other of said players places one of said playing markers in non-diagonal adjacent relation to a previously placed playing marker, said playing markers being placed in turn by said players in like fashion to form said rows and columns;

each of said rows and columns being limited to a total of three playing markers arranged in a generally rectangular array;

whereby the game winner is the one of said players to be the first with three of the corresponding ones of said first and second indicia on said playing markers disposed in a row, a column, or diagonally.

2. The method as defined by claim 1 wherein said first indicia is an "X" and said second indicia is an "O", said single playing marker having both an "X" and an "O" thereon.

3. The method as defined by claim 1 wherein said playing markers are playing cards, said playing cards being shuffled and dealt such that each of said players has four of said playing cards.

4. The method as defined by claim 1 including a placement area for said playing markers, said placement area having a plurality of marker-receiving spaces, said marker-receiving spaces including said starting point.

5. The method as defined by claim 4 wherein said marker-receiving spaces include a middle space defining said starting point, said marker-receiving spaces being arranged to define a plurality of rows and columns thereon.

6. The method as defined by claim 5 wherein each of said rows and columns is defined by five of said marker-receiving spaces, the remaining one of said playing markers being positioned at said starting point.

7. The method as defined by claim 4 wherein said playing markers are wearable markers for a plurality of persons, said persons being chosen by said players such that each of said players has four of said persons.

8. The method as defined by claim 7 wherein all of said persons blindly select one of said wearable markers and the remaining one of said persons is positioned at said starting point.

* * * * *